US005510194A

United States Patent [19]

Hendricks et al.

[11] Patent Number: 5,510,194

[45] Date of Patent: Apr. 23, 1996

[54] PERFORATED PLATE FILTER MEDIA AND RELATED PRODUCTS

[75] Inventors: John B. Hendricks; Michael L. Dingus, both of Huntsville, Ala.

[73] Assignee: Alabama Cryogenic Engineering, Inc., Huntsville, Ala.

[21] Appl. No.: 54,315

[22] Filed: Apr. 27, 1993

Related U.S. Application Data

[63] Continuation-in-part of Ser. No. 800,220, Nov. 27, 1991, Pat. No. 5,298,337, which is a continuation-in-part of Ser. No. 530,873, May 29, 1990, which is a continuation-in-part of Ser. No. 375,709, Jul. 5, 1989, Pat. No. 5,101,894.

[51] Int. Cl.[6] ..... B01D 36/00

[52] U.S. Cl. ..... 428/556; 55/347; 210/323.1; 210/359

[58] Field of Search ..... 428/556; 317/230; 55/347; 210/323.1, 359

[56] References Cited

U.S. PATENT DOCUMENTS

| | | | |
|---|---|---|---|
| 3,228,460 | 1/1966 | Garwin | 165/81 |
| 3,506,885 | 4/1970 | Roberts et al. | 317/230 |
| 3,578,163 | 1/1971 | Warning | 210/75 |
| 3,612,397 | 10/1971 | Pearson | 239/127.1 |
| 3,645,298 | 2/1972 | Roberts et al. | 138/40 |
| 3,690,045 | 9/1972 | Neumann | 55/356 |
| 3,692,099 | 9/1972 | Nesbitt et al. | 165/10 |
| 3,814,257 | 6/1974 | Schmidt, Jr. | 210/332 |
| 4,064,045 | 12/1977 | Schmidt, Jr. | 210/81 |
| 4,227,904 | 10/1980 | Kasmark, Jr. et al. | 55/316 |
| 4,298,187 | 11/1981 | Dantzig et al. | 266/217 |
| 4,332,680 | 6/1982 | O'Cheskey | 210/143 |
| 4,361,489 | 11/1982 | Kilsdonk et al. | 210/780 |
| 4,388,057 | 6/1983 | Bachmann et al. | 425/97 |
| 4,521,231 | 6/1985 | Shilling | 55/302 |
| 4,793,928 | 12/1988 | Tsukamoto et al. | 210/344 |
| 4,867,629 | 9/1989 | Iwasawa et al. | 414/331 |
| 4,968,333 | 11/1990 | Ellis et al. | 55/341.1 |
| 5,028,036 | 7/1991 | Sane et al. | 266/227 |
| 5,128,029 | 7/1992 | Herrmann | 210/107 |
| 5,154,742 | 10/1992 | Gault et al. | 55/269 |
| 5,160,633 | 11/1992 | Hong et al. | 210/739 |
| 5,185,015 | 2/1993 | Searle | 55/102 |
| 5,244,480 | 9/1993 | Henry | 55/213 |
| 5,268,009 | 12/1993 | Thompson | 96/67 |

OTHER PUBLICATIONS

Brochure entitled "Collimated Hole Structures," author unknown, published by Technical Products Division, Brunswick Corporation, 1968.

*Primary Examiner*—Donald P. Walsh
*Assistant Examiner*—Scott T. Bluni
*Attorney, Agent, or Firm*—Joseph H. Beumer; C. A. Phillips

[57] ABSTRACT

Perforated plates for use as filter media and devices for fluid injection and extrusion have a multiplicity of holes of a uniform size and a selected diameter as small as 0.5 micron. The plates are made by a "wire drawing" process wherein a sacrificial wire material in a plate metal can is repeatedly extruded and restacked, elongating the wire and reducing its diameter. Plates are then cut from the extruded composite, and the wire metal is removed by selective etching. By use of this process, perforated plates with several features unavailable previously are obtained. In particular, the plates have much smaller holes, higher porosity, and uniform size and shape, along with any desired thickness and a high length-to-diameter ratio. Such plates are ideally suited for use as a medium for various types of filters where removal of contaminants sized in the lower micron range is desired. Size and distribution of the holes in the plate are precisely controllable, enabling separations of materials of specific sizes.

2 Claims, 6 Drawing Sheets

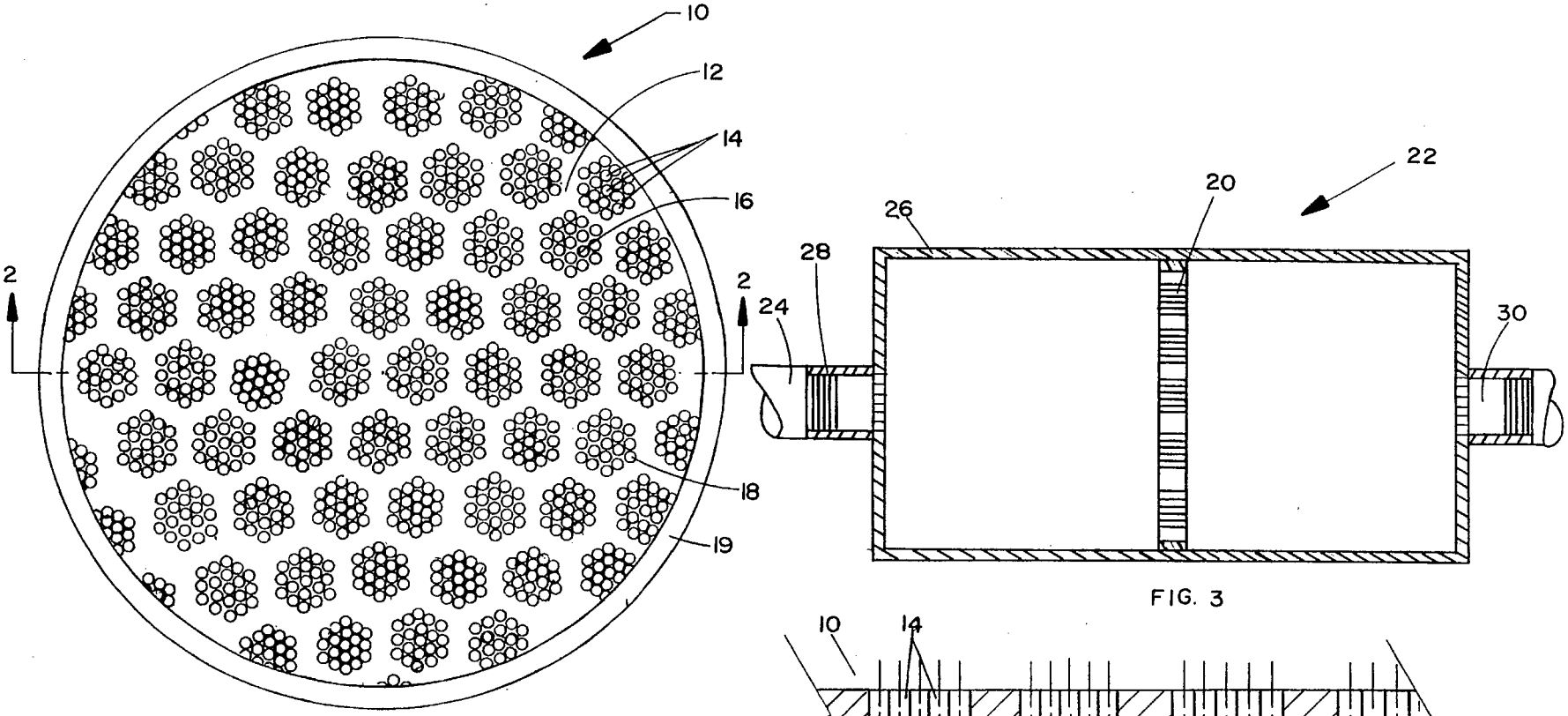
FIG. 1
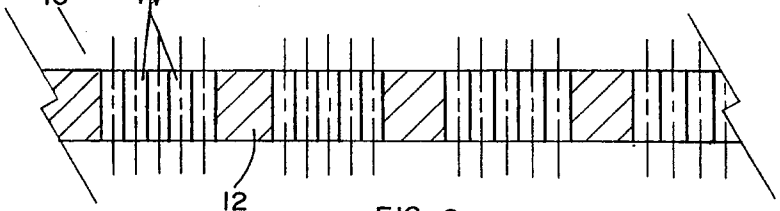
FIG. 2
FIG. 3

PERFORATED PLATE FILTER MEDIA AND RELATED PRODUCTS

REFERENCE TO RELATED APPLICATIONS

This application is a continuation-in-part of application Ser. No. 07/800,220, filed Nov. 27, 1991, now U.S. Pat. No. 5,298,337, issued Mar. 29, 1994 which in turn is a continuation-in-part of application Ser. No. 07/530,873, filed May 29, 1990, which in turn is a continuation-in-part of application Ser. No. 07/375,709, filed Jul. 5, 1989, now U.S. Pat. No. 5,101,894, issued Apr. 7, 1992.

FIELD OF THE INVENTION

This invention relates generally to filters, separation equipment, and injector elements.

BACKGROUND OF THE INVENTION

Perforated metal plates are useful as filter media for mechanical filters. Filters of this type operate on the basis that the filter medium works as a simple porous barrier screen, removing and retaining solid particles too large to pass through the medium, but allowing the fluid in which the particles are suspended and particles smaller than the pores to pass through. These filters in effect provide direct interception of solids, with only a minor involvement of phenomena such as depth filtration which are major contributing mechanisms in other types of filtration. The intercepted particles are stopped at the upstream surface of the perforated plate, their size preventing them from passing through the pores. Surface retention of the particles provides an advantage in that the particles may be readily removed, allowing for re-use of the plate medium. Perforated metal plates also offer potential advantages in their strength and resistance to corrosion and capability for service in high-temperature fluids or in high-pressure applications as compared with other types of filter media.

While potentially favorable aspects of perforated plate filter media are well-known, practical limitations have been imposed on their use owing to the difficulty of fabricating them with desired perforation sizes. As stated in *Solid/Liquid Separation Technology* by Derek B. Purchas, published by Uplands Press Ltd. (1981), at pages 116–117:

> The use of perforated metal sheets as filter media is generally of very restricted interest since standard metal working techniques are unable to produce holes of sufficient fineness and regularity, excepting for applications such as in roughing strainers; for example, the finest grade in the very extensive range of Greenings has holes of 0.26 in. (i.e., 660 microns), the porosity of this being 22.6%.
>
> Expanded metal sheets have diamond-shaped apertures even the smallest of which in the so-called Micromesh range typically is 0.75 mm×0.60 mm (along its long and short axes, respectively).
>
> From the filtration point of view, the most useful range of perforated metal sheets are those made by electroforming techniques combined with photoetching. This is the basis of the two ranges of nickel products available from Veco, the one being sheets with a maximum size of 200×200 mm, with holes as small as 5 microns (tolerance being ±2 microns on holes up to 500 microns); such small holes result in very low porosities, down to less than 2%.

> The second range comprises sheets of 1 m×1 m; the finest grade has 0.04 mm (40 microns) holes, with a porosity of 3.5%, other hole sizes and porosities being 60 microns (8%), 80 microns (14.5%), 100 microns (22.5%), all of these being at a pitch of 0.20 mm with a key thickness of between 0.04 and 0.07 mm. In practice, there are numerous variations of factors such as pitch and shape of hole, result in a wide variety of grades with holes up to 5 mm.

These limitations of perforated plates to large pore sizes and low porosities have served to render perforated plates unsuitable for many important filtration applications. In terms of pore size, pollutants such as various types of dust, liquid mist particles, bacteria, pollens, spores, and other biological materials are smaller in most cases than the available pore sizes so that such materials would pass through such a medium unaffected. In particular, pore sizes down to less than one micron in diameter are needed.

In addition to smaller pore sizes, a higher total porosity is needed for applications requiring a high throughput or involving exposure to pressurized fluids. As stated above, prior perforated metal sheets with pore sizes as small as five microns provide a porosity of less than two percent. A much higher porosity is required for practical applications. Uniformity of pore size and of distribution have also been lacking in prior plates at the smaller sizes. Filter media are rated on their ability to remove particles of a specific size from a fluid. Ideally, the medium would have a precise cut-off point, which refers to the largest particle, normally expressed in microns, which would pass through the filter. In practice, filter media at the smaller sizes have pore sizes extending over a considerable range of values, rather than a single precise value. The ability to selectively remove particles of specific size would be enhanced by providing plates with a controlled, uniform pore diameter. Maximum uniformity of pore shape as well as size is needed to provide for separation of materials within precise, narrowly defined size ranges.

Another important feature needed for perforated plate filter media is a high degree of strength and durability such as to allow the plate to be subjected to removal of particles and to be reused, after undergoing sterilization, chemical cleaning, or the like.

Requirements also exist for perforated plates with properties similar to those discussed above for applications involving an injection or extrusion step. Very small and uniform size pores, consistent with strength and durability, are important for such purposes.

SUMMARY OF THE INVENTION

The present invention is directed to perforated metal plates for use in filters and other separation and injection and extrusion equipment. Plates with uniformly sized and shaped pores at a selected size down to well below one micron and having a uniform cross section throughout the thickness of the plate are obtained by means of a compound "wire drawing" process wherein a sacrificial wire material is disposed lengthwise in an extrusion can and is surrounded by a desired plate material to form a billet. The billet is initially extruded and then restacked and drawn repeatedly, with the wire material being thinned out by each cycle. When the desired wire diameter is reached, the wire-containing billet is cut into plates, and the wire is selectively etched away, leaving perforated plates.

In addition to providing uniform-sized pores having a diameter much smaller than available previously, the perforated plates of this invention exhibit numerous other desirable features and advantages. A selected total porosity up to fifty percent of the plate area, and even higher in the case of certain non-circular holes, may be provided, thus enabling a high fluid flow through the plate and allowing use of such plates as filter media in pressurized or high pressure systems. The plates may be made at any desired thickness by selecting the location of cuts across the billet in making the plates. This provides for relatively thick plates, for example, up to one-fourth inch thick, with high strength and durability and ruggedness enough to withstand high pressure and repeated cycles of cleaning when used as a filter medium. The holes in such plates exhibit a high length-to-diameter ratio, which is important for some applications.

Distribution of pores and hole dimensions may be varied at different locations across the plate, for example, some regions may be given small holes, some larger holes, and some no holes at all, all in the same plates.

Another important feature of plates embodying the invention is that the high degree of uniformity of pore size provides a sharp, well-defined cut-off point, thus enabling precise separation of different size materials from a mixture in a fluid. This is in contrast to prior porous material such as sintered metals and ceramics which, in the smaller sizes of interest, lack uniformity and which require consideration in terms of an average pore size, with actual sizes varying over a substantial range.

Plate characteristics made available by the invention open the way for a wide variety of filtration applications. Single plates may be used as a flat disc or strainer or filter medium mounted in a housing, with a fluid passing perpendicularly through the plate. Multiple plates may be placed between spacers in a stacked array, with the plates having the same hole size, or in a graded configuration adapted for removal of coarse particles by a first plate having a larger pore size and progressively finer particles by succeeding plates with smaller hole sizes. Multiple plates may also be mounted in a supporting structure to form a large single filtration surface of a selected geometry including, but not limited to flat, cylindrical, domed (parabolic or spherical), fan-fold, or pleated. The plates may also be placed in a rotary drum or disc filter provided with a scraper for removal of deposited particles.

The plates may be made of a wide variety of metal or alloys that are amenable to being extruded or drawn as required in the fabrication process. This allows for selection of a particular material for compatibility with a specific environment in terms of chemical, thermal, and mechanical requirements. In particular, the plates can be made of copper, niobium, stainless steel, nickel, nickel-based alloys, and silver. In each case, the plate metal is co-extruded with a "wire" metal that is selectively removable with an etchant in the manufacturing process.

The availability of perforated plates with uniform holes of a selected size in the lower micron range allows separation of many biological contaminants such as most bacteria, pollen, spores, and the like as well as inorganic dust and chemical contaminants. For filtration of fluids such as air or water containing particles of these sizes along with even smaller particles, filter media of the present invention may be used a first stage in combination with a subsequent stage using a medium having a smaller pore size, for example, a membrane filter.

Perforated plates embodying the invention are also useful for other applications wherein a first fluid is forced through small openings for injection or distribution into a second fluid or a solid or a viscous material is extruded through multiple openings. These applications may take the form of aeration and water purification devices wherein a gas is dispensed into a liquid as tiny bubbles, in fuel injectors, and in spinnerets through which synthetic materials are extruded in the manufacture of fibers.

It is, therefore, an object of this invention to provide a perforated metal plate filter medium having a multiplicity of uniform-size pores with a selected diameter down to the lower micron size range.

Another object is to provide such a perforated metallic plate filter medium having pores of uniform geometry throughout the thickness of the plate.

Yet another object is to provide a perforated metal plate filter medium having uniform size holes of a selected diameter such as to enable precise separation from fluids of particles having a specified size.

Still another object is to provide a perforated metal plate having a multiplicity of uniform-sized pores of a diameter such as to remove most bacteria and other biological contaminants from fluids passing through the plate.

Another object is to provide perforated plates having a high degree of porosity, consistent with strength and durability.

A further object is to provide perforated metal plates suitable for injection of one fluid into another fluid.

Another object is to provide perforated metal plates for use in spinnerets through which synthetic fibers are extruded.

Other objects and advantages of the invention will be apparent from the following detailed description and the appended claims.

BRIEF DESCRIPTION OF THE DRAWINGS

FIG. 1 is a top plan view of a perforated plate filter medium embodying the invention.

FIG. 2 is a fragmentary sectional view taken along a portion of line 2—2 of FIG. 1.

FIG. 3 is a view, partly in section, of a filter for removing contaminants from a hydraulic liquid line.

DESCRIPTION OF THE PREFERRED EMBODIMENT

Figure 8:
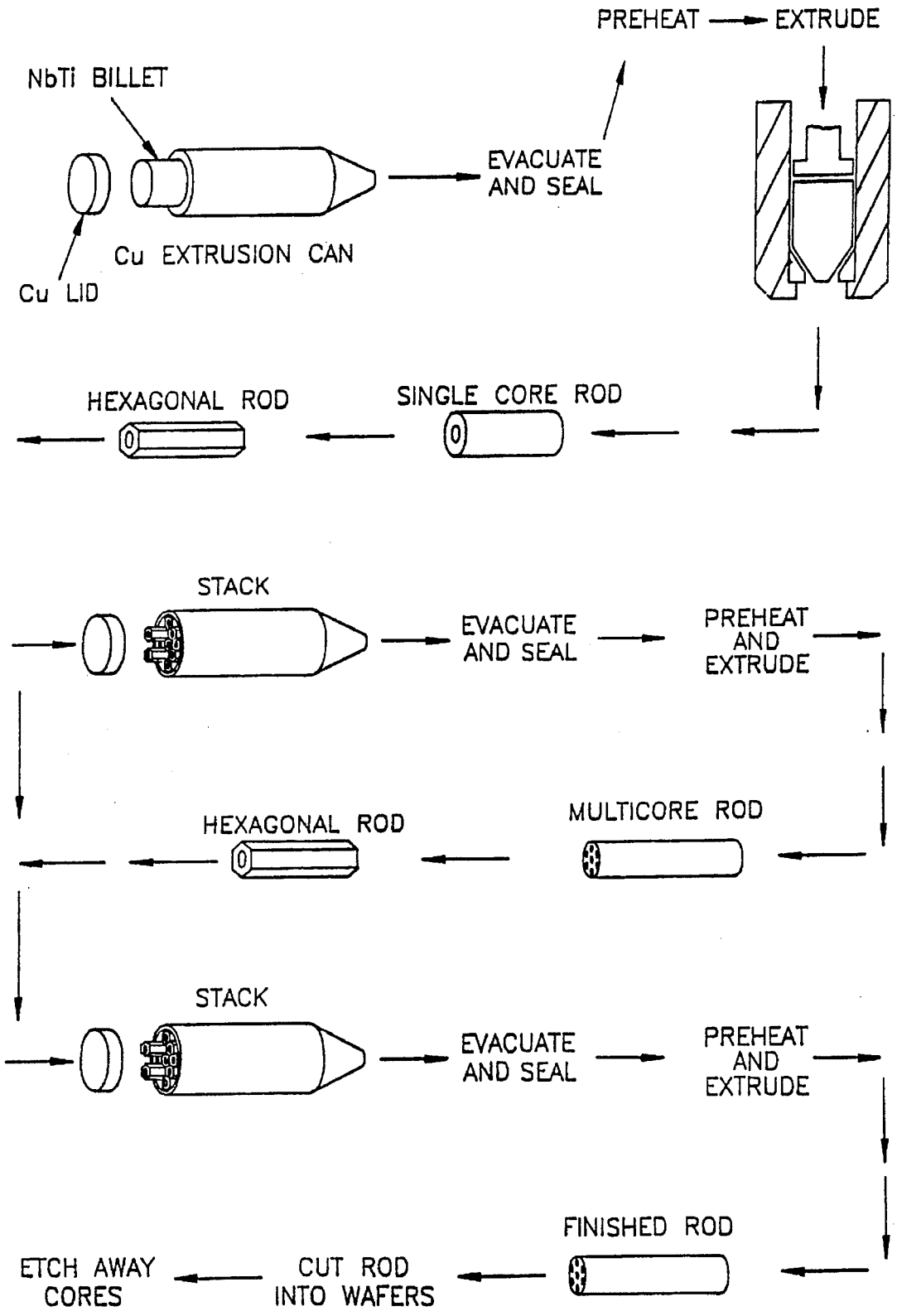
FIG. 8 is a schematic view of a process for preparing perforated plates for use in the invention.

Referring to FIG. 1 of the drawings, there is shown a perforated metal plate 10 embodying the invention. The plate has a metal matrix 12 penetrated by a multiplicity of circular holes 14 spaced throughout the plate in hexagonal groups 16. (The diameter of the holes is enlarged in this view, exaggerated for the purposes of clarity.) The groups of holes are separated from one another by solid regions 18 in a pattern that results from the manner of stacking of hexagonal rods in the manufacturing process. An outer rim 19 extends around the circumference of the plate. The presence of solid regions between groups of holes and the solid outer rim are not critical and may be avoided by varying the manufacturing process. The holes have highly uniform dimensions and spacing throughout the plate and have a uniform cross section across the plate as shown in FIG. 2. These characteristics result from the fabrication process as illustrated in FIG. 8 wherein the individual wires, which are later etched away to form holes, are each extruded under identical conditions. The holes shown in FIG. 1 have a round cross section by virtue of using a round billet in the first step of the preparation process. Other shapes such as square, hexagonal, or star-shaped may be obtained by using a billet with a corresponding cross-sectional shape, which is maintained throughout subsequent re-extrusion steps.

The holes in the plate may have a diameter down to approximately 0.5 micron. An exact lower limit has not yet been established, but practical considerations would likely prevent making holes with smaller diameters; sizes down to 0.8 micron have actually been demonstrated. At hole sizes above about 1/16 inch (1,600 microns), the invention loses its advantages over previously known perforated plates made by methods such as stamping or drilling. An optimum size of a particular filtering application would be selected, depending on the size of the particles to be filtered from a fluid.

Porosity of the plate may be controlled in the preparation process to obtain a selected value of up to 50 percent for circular holes and up to 70 percent for hexagonal or square holes. For most applications, a porosity of 30 to 60 percent is preferred in order to obtain a minimum reduction in flow across the plate, consistent with strength and durability. Thickness of the plate may also be varied as required for a particular application. For use in pressurized systems or under conditions where the plate is exposed to substantial stress, a thickness of 1/32 to 1/4 inch (0.79 to 6.35 millimeters) is preferred. This feature is readily controlled by cutting the finished rod into a wafer of a desired thickness in the preparation process.

FIG. 3 shows an illustrative embodiment wherein a perforated plate filter medium 20 is used in a filter 22 disposed across a hydraulic line 24. The filter has a housing 26, an input 28 through which hydraulic oil is pumped by means not shown, and an outlet 30 through which the filtered oil is withdrawn. The hole size may be selected to provide appropriate filtration for a specific system. In general, a hole size in the range of 1 to 40 microns is used in accordance with the following recommended filter ratings as given in *Filters and Filtration Handbook,* Gulf Publishing Company (1981), page 362:

Accepting 25 μm as a general level of protection required for low pressure industrial hydraulic systems, and in the absence of specific requirements from the component manufacturers, the following filter ratings are recommended for different systems:

| | filter rating |
|---|---|
| Low pressure systems with generous clearances | 25–40 μm |
| Low pressure heavy-duty systems | 15–25 μm |
| Typical medium pressure industrial systems | 12–15 μm |
| Mobile hydraulic systems | 12–15 μm |
| General machine tool and other high quality systems | 10–12 μm |
| High performance machine tool and other high pressure systems where reliability is critical | 3–5 μm |
| Critical high pressure systems and controls using miniature components | 1–2 μm |

The specific hole size may thus be selected, depending on system requirement. A porosity of 30 to 60 percent and a plate thickness of 1/32 to 1/4 inch (0.79 to 6.35 millimeters) are preferred for filters for such systems, with thicker plates being used for high-pressure applications.

Figure 4:
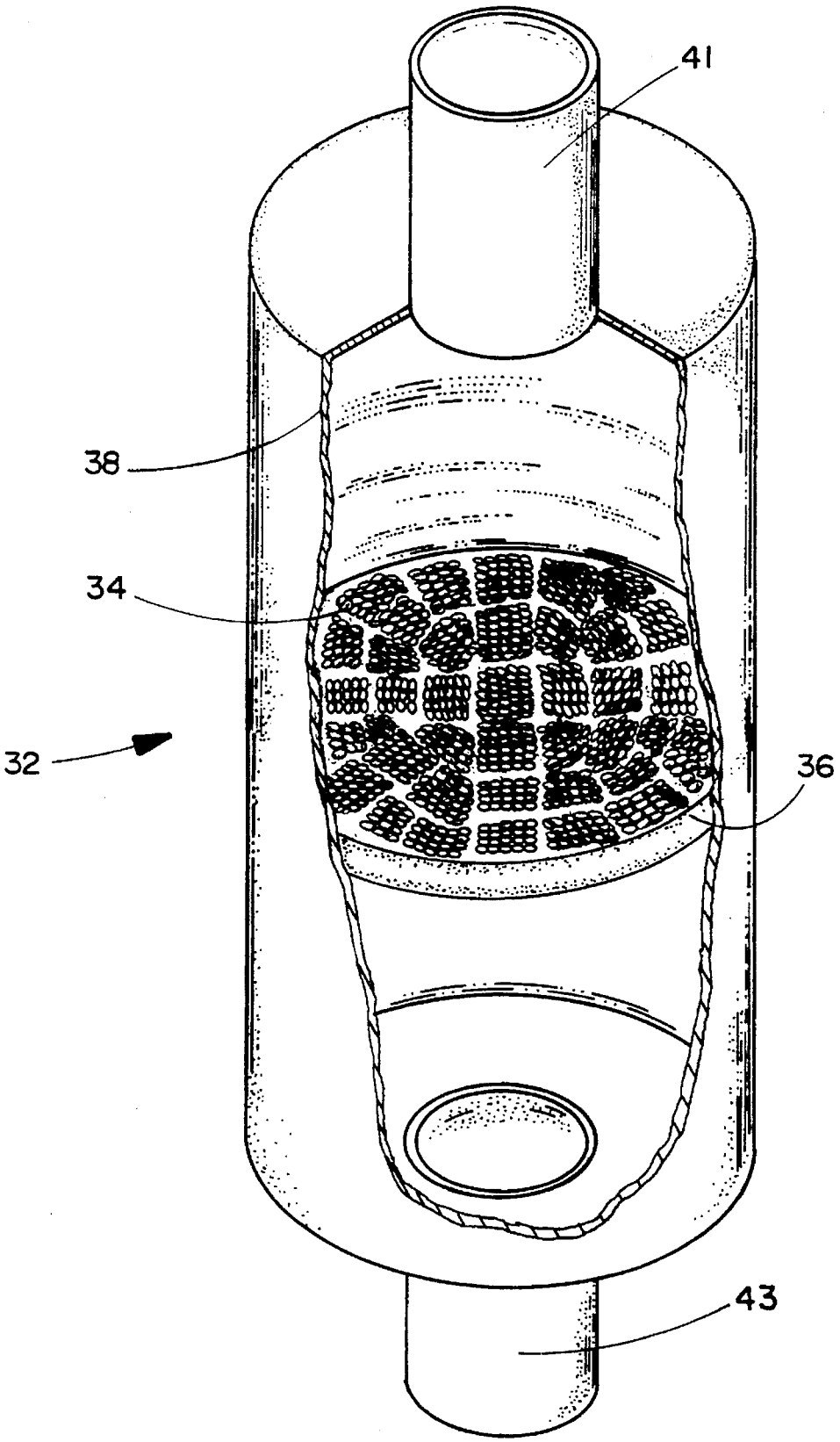
FIG. 4 is a pictorial view, partly broken away, of an air filter including an array of perforated plates.

FIG. 4 shows an embodiment wherein an air filter 32 with multiple perforated plate elements 34 mounted in a supporting substrate 36 is secured to housing 38. The filter has an inlet pipe 41 communicating with an air duct (not shown) and an outlet pipe 43 for egress of filtered air. Hole size, porosity, and plate thickness for this embodiment may be selected depending on filtration requirements for a specific system. In general, a minimum hole size, maximum porosity, and a thickness such as to provide high strength are preferred for this application, and specific values of 0.5 to 20 microns hole size, 30 to 60 percent porosity, and 1/64 to 1/8 inch (0.40 to 3.17 millimeters) thickness are suitable for this purpose. The mounting of the individual plate elements to the substrate as well as mounting of the substrate to the housing may be accomplished by conventional welding.

Although filters with a single perforated plate element may be used for this application, multiple elements are preferred inasmuch as flow requirements for bulk air filters would normally be relatively high so that a large plate area would be needed. As a practical matter, the plate area available in a single plate is limited by the size of extrusion equipment used in making the plates. Thus, separate, smaller plates are combined into a larger array to provide the desired area.

Figure 5:
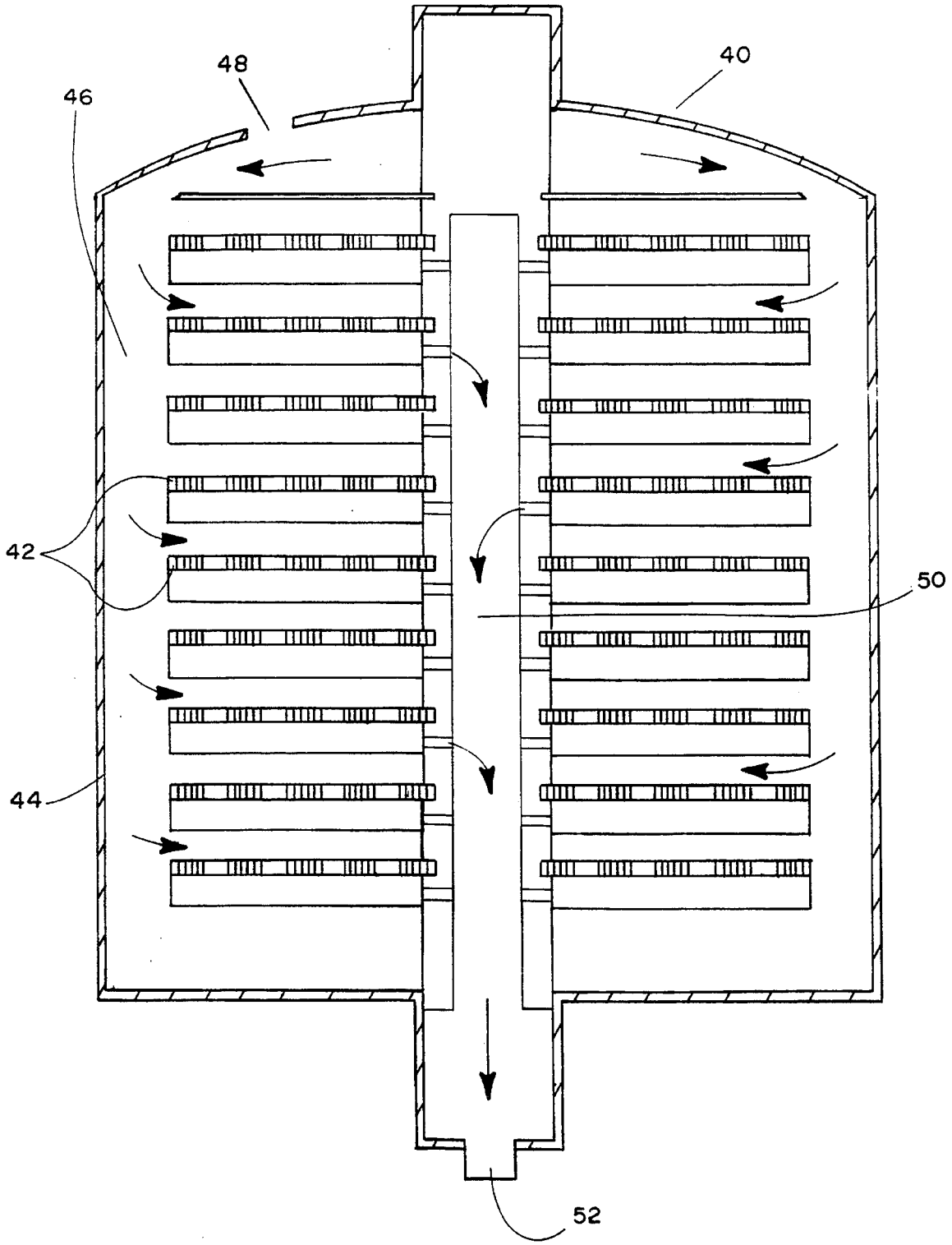
FIG. 5 is an elevational view, partly in section, of a "leaf" filter embodying the invention.

A leaf filter 40 employing a stacked array of vertically spaced-apart circular perforated plates 42 is shown in FIG. 5. This filter has a vertically disposed cylindrical housing 44 and an open annular space 46 around the circumference of the plates 42. A liquid being filtered is introduced under pressure at an axially located inlet 48 at the top and is forced to pass through the plates while moving inwardly from the annular space 46 to axial space 50 leading to exit 52. This filter is useful for removing solid particulates from liquids. For such applications, a perforation size of 1 to 200 microns is preferred, along with a porosity of 30 to 60 percent and a plate thickness of 1/64 to 1/8 inch (0.40 to 3.17 millimeters).

Figure 6:
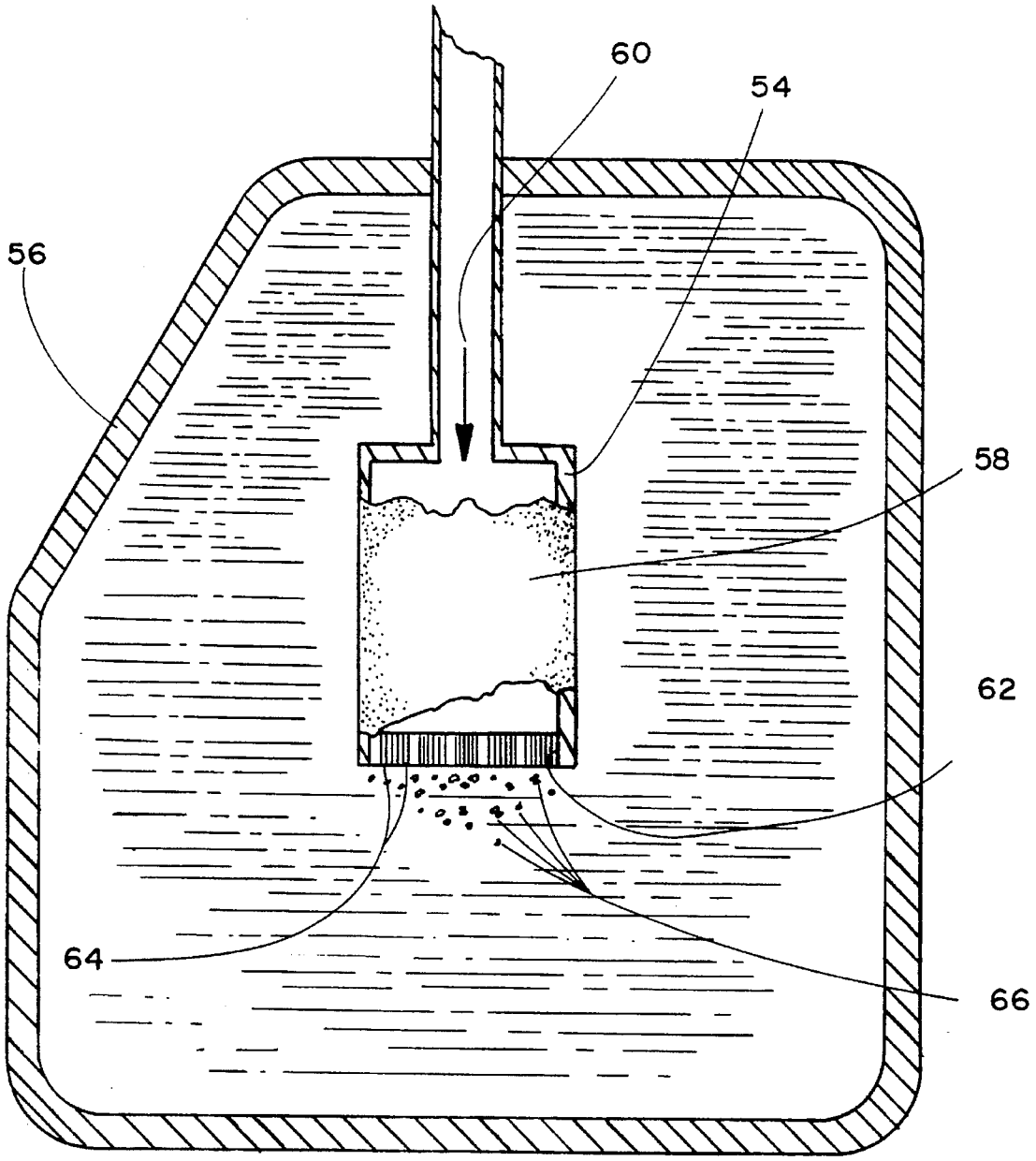
FIG. 6 is an elevational view, partly in section, of a perforated plate fluid injector.

FIG. 6 shows a fluid injector 54 by means of which a gas is introduced into and dispersed within a liquid container 56. The injector has a cylindrical housing 58 with a gas inlet 60 at the top by means of which a pressurized gas is introduced from a source not shown. Perforated plate 62 having a multiplicity of extremely small holes 64 is disposed across the bottom end of the container, dispersing the gas into small bubbles 66 as it passes through. Injectors of this construction may be used for aeration and purification of water and in similar applications where dispersal of gas to form very small gas bubbles within a liquid is desired. Perforated plate injectors may also be used for injecting and atomizing or finely dispersing liquids into defined locations, for example, for injecting diesel fuel or gasoline into a cavity within an engine. For liquid injection applications, a perforation size of 10 to 300 microns, a total porosity of 30 to 60 percent, and a plate thickness of 1/64 to 1/16 inch (0.40 to 1.59 millimeters) are preferred.

Figure 7:
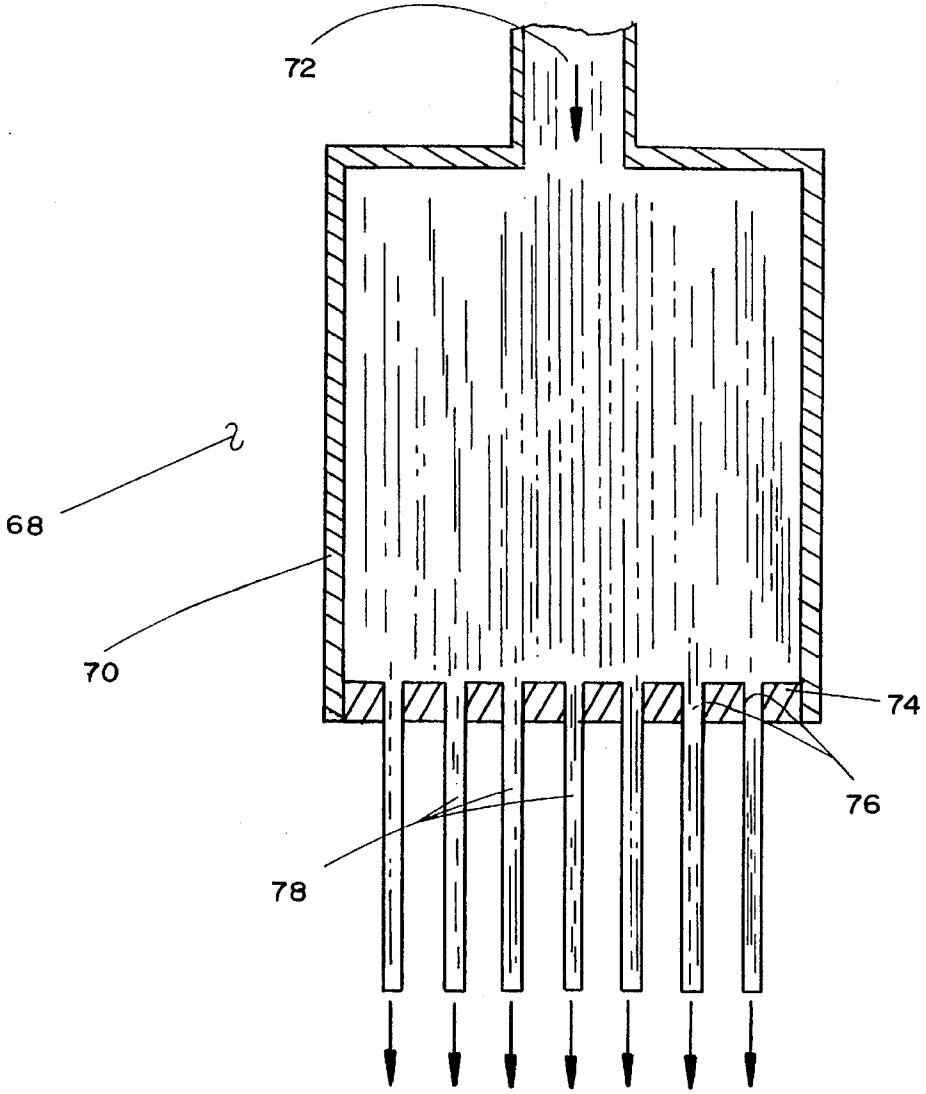
FIG. 7 is an elevational view, partly in section, of a perforated plate extrusion element for a spinneret.

FIG. 7 shows a spinneret 68 for extrusion of synthetic resin material in the manufacture of resin filaments for yarn or the like. The spinneret has a housing 70 into which flowable, heated resin 72 is forced by means not shown. A perforated plate 74 with very small holes 76 extends across the bottom of the housing. Upon passage through the plate, the resin is formed into fine filaments 78 which solidify upon cooling after passage through the plate. Spinnerets embodying the invention are useful for making resin filaments with a very small and uniform diameter. A special advantage is provided in that a precisely defined hole diameter may be obtained in these plates. A hole size of 1 to 300 microns, a porosity of 10 to 60 percent, and a plate thickness of 1/64 to 1/16 inch (0.40 to 1.59 millimeters) are preferred.

Preparation of perforated plates embodying the invention is schematically illustrated in FIG. 8. The plate material in this embodiment is copper, and the sacrificial wire material is a niobium-titanium alloy. A generally cylindrical extrusion can, conical at one end, is made up of copper, and a cylindrical billet of sacrificial niobium-titanium alloy is placed inside the can. A lid of copper is then fitted over the flat end of the can, and the assembly is evacuated and sealed by welding. The sealed can is preheated to a temperature of at least 400° C. and extruded through a die to obtain an elongation of fifty percent or more. An extruded cylindrical rod made up of niobium-titanium core surrounded by copper is produced in this step. Subsequent size reductions are then carried out by extrusion steps in which the rod is pushed through a die or by drawing in which the rod is pulled, but drawing is preferred after the initial size reduction. In order to enable stacking of an array of single core rods, the rods are then converted to hexagonal shape as shown by drawing through a hexagonal die or machining as required. The hexagonal single core rods are then stacked within a cylindrical copper can, and the can is provided with a lid and is subjected to preheating and re-extrusion in the same manner as for the starting billet. Repeated sequences of extrusion or drawing, conversion to hexagonal shape, and stacking are carried out until the billet material is thinned out to a desired diameter. At this point, the finished rod is cut into wafers, giving a desired plate thickness. The sacrificial material is etched away by hydrofluoric acid, leaving a matrix of copper with a multiplicity of small diameter holes having a uniform cross section throughout the plate thickness.

It may be seen from the above that perforated metal plates embodying the invention lend themselves to many applications where the combined features of extremely small hole size, uniformity of hole size and geometry, and high porosity are important. In addition, the ruggedness and resistance of these plates to difficult environments provide for prolonged service in these applications.

While the invention is illustrated above with respect to various specific embodiments, it is not to be understood as limited thereto, but is limited only as indicated by the following claims.

We claim:

1. An air filter for removing contaminants from an air stream comprising:

a housing having an inlet and an outlet and disposed across a duct carrying said air stream;

a support member disposed across said housing;

a plurality of perforated plates secured to said support member and arranged for flow from said air stream through said plates; and said plates having a multiplicity of uniform sized holes of a selected diameter in the range of 0.5 to 20 microns and a porosity of 30 to 60 percent.

2. The air filter as defined in claim 1 wherein said plates are mounted on a supporting substrate in spaced-apart relation to one another.

* * * * *